US007641539B2

(12) United States Patent
Ali et al.

(10) Patent No.: US 7,641,539 B2
(45) Date of Patent: Jan. 5, 2010

(54) HOLDER FOR SANDING BLOCK

(75) Inventors: Terry Ali, Fairborn, OH (US); Christopher Ali, Beavercreek, OH (US)

(73) Assignee: Ali Industries, Inc., Fairborn, OH (US)

( * ) Notice: Subject to any disclaimer, the term of this patent is extended or adjusted under 35 U.S.C. 154(b) by 0 days.

(21) Appl. No.: 11/935,671

(22) Filed: Nov. 6, 2007

(65) Prior Publication Data

US 2009/0117836 A1 May 7, 2009

(51) Int. Cl.
*B24D 15/00* (2006.01)

(52) U.S. Cl. ..... 451/523; 451/524; 451/525

(58) Field of Classification Search ..... 451/523–525
See application file for complete search history.

(56) References Cited

U.S. PATENT DOCUMENTS 3,549,188 A * 12/1970 Cerasoli ..... 81/53.12
4,331,193 A * 5/1982 Tudisco ..... 81/22
4,391,013 A 7/1983 Janssen
4,719,063 A * 1/1988 White ..... 264/45.2
5,099,538 A * 3/1992 Gaconnet ..... 15/93.1
5,337,523 A * 8/1994 Walsh ..... 451/502
5,382,189 A * 1/1995 Arendall ..... 451/557
5,500,049 A 3/1996 Kolinsky
5,662,519 A * 9/1997 Arnold ..... 451/525
5,713,104 A * 2/1998 Giampaolo, Jr. ..... 16/422
5,718,622 A * 2/1998 Jones ..... 451/524
5,926,901 A * 7/1999 Tseng et al. ..... 15/167.1
6,220,128 B1 * 4/2001 Hu ..... 81/489
6,267,658 B1 * 7/2001 Ali et al. ..... 451/523
6,379,237 B1 * 4/2002 Gordon ..... 451/523
6,616,519 B2 9/2003 Mansfield
6,688,958 B1 * 2/2004 Jones et al. ..... 451/557
7,186,174 B1 3/2007 Arnold
2002/0069715 A1 * 6/2002 Genco ..... 74/127
2006/0048319 A1 * 3/2006 Morgan et al. ..... 15/104.94

* cited by examiner

*Primary Examiner*—Maurina Rachuba
(74) *Attorney, Agent, or Firm*—R. William Graham

(57) ABSTRACT

A holder for releasably retaining an abrasive block includes a base having a bottom surface and a wall extending outward therefrom which together define a abrasive block receiving surface to friction fit receive the abrasive block, and a polyfoam handle connected to the base and which extends upward from a top surface of the base.

18 Claims, 4 Drawing Sheets

HOLDER FOR SANDING BLOCK

BACKGROUND OF THE INVENTION

1. Field of the Invention

The invention relates generally to the field of sanding devices. More particularly, but not way of limitation, the present invention relates to improvements in holders for sanding blocks.

2. Related Art

Sanding pads and blocks have been described in many different forms. A common type of block is in the form of an expanded foam material having one or more abrasive surfaces. In one case, the abrasive surface is formed on four elongated sides of the block and is known in the art as a sanding sponge having a feature of deformability so that the pressure applied can be varied to change the amount of sanding performed. Several prior devices exist which show holders for such blocks.

U.S. Pat. No. 6,616,519 discloses a rectangular backing pad 1, provided with an integrally molded handle, 2, is provided, at points adjacent two opposed ends, with two screw shafts, 3, molded into and projecting perpendicular to the plane of the backing pad. A rectangular foam sanding pad, 5, having at least one abrasive surface, 6, contacts the backing pad and is retained in contact therewith by retaining members, 7, having an L-shaped cross-section with teeth, 8, adjacent one end which penetrate the sanding pad. At the opposed end of the retaining member a hole, 4, fits over the screw shaft, 3, and the retaining member is secured in position by a wing nut, 9. The backing plate and handle are made of a rigid material such as metal or plastic or wood.

To mount the pad it is necessary to place the pad in contact with the backing plate and the drive the teeth of the retaining member into the body of the foam at each end and secure the retaining members on the attachment means using the wing nuts. When the sanding surface needs to be changed, the retaining members are removed and the pad is rotated to place a new surface of the pad in position to sand a workpiece surface and the retaining members are replaced.

Another sanding bock holder is described in U.S. Pat. No. 7,186,174. This patent discloses an apparatus 10 which is a sanding block holder incorporating locking tabs 22 used to lock the removable side wall 20 into a compressing state upon the sanding block 16. To release compression on the sponge 16, the tab 22 is simply pushed inward and the removable side wall 20 is then pulled out. Additionally, a track 24 with a sliding tab 26 are fabricated to work in cooperation with the handle base 18 and locking tab 22 to provide stability to the removable side wall while sliding into place. A rigid handle 14 is attached to the handle base 18.

U.S. Pat. No. 6,379,237 discloses a holder 1 including a sanding sponge 2 is shown in an assembled condition. The holder generally comprises a base 10 adapted for interchangeable connection to a handle 25. End surfaces 12 each include one or more inwardly directed and preferably pointed teeth 13 that penetrate the sponge to hold and retain it inside base 10. If the base is made of metal, the teeth can be punched from the material of the side surfaces or they can be welded in place. If the base is made of plastic, the teeth can be molded integrally with the side surfaces.

In addition, there exists a variety of styles of sanding blocks. These sanding blocks are generally integrally formed of rubber or foam. A conventional type of sanding block includes an intermediate portion and a pair of ends wherein a top surface is configured to be hand held and a bottom surface and ends include retention surfaces for holding sandpaper.

Other types of sanders include means for removably attaching sandpaper to a bottom surface of the sander by means of adhesion or hook and loop connection.

Present holders for sanding blocks have not, however, evolved to meet the needs of the user. It is desirable to minimize fatigue to the user while maintaining the effectiveness of the sanding block. Such holders for sanding blocks are presently formed of a relatively rigid material which while preferred for holding the block is also tiresome to work with for extended periods of time. This is particularly true for women which are increasingly entering into the do-it-yourself market.

The present invention overcomes these deficiencies of present holders of sanding blocks. The present invention also meets the needs of present day consumer.

BRIEF SUMMARY OF THE INVENTION

It is an object of the invention to provide an ergonomically improved holder for a sanding block, such as a sanding sponge.

It is another object of the invention to enhance the ease of use of a holder for a sanding block while maintaining effectiveness of the same.

In accordance with the present invention a holder for an abrasive (sanding) block, such as a abrasive sponge, includes a base having a bottom surface and a wall extending outward therefrom which together define a sanding block receiving surface to friction fit receive the block. The receiving surface and the block have shapes that cooperate with each other to provide friction forces therebetween which are greater that that between a working surface of the block and a surface being sanded. The base can preferably be made of a rigid material.

The holder further includes a handle which protrudes, preferably centrally, from a top surface of the base. The handle is generally of a shape which conforms to the palm of a user's hand and is preferably formed of a polyfoam material for ease of comfort to the user. The handle is ergonomically designed, being symmetrically oriented along a longitudinal axis which generally aligns with a central axis of the base. The handle has a front end and a disproportionate back end. The back end is larger than the front end such that a downward slope exists from the back end to the front end and can preferably be formed in a manner as seen in FIG. 1. The shape of the handle and the orientation of the handle, with respect to the base of the present holder, are designed such that the sanding block and the user can interact most efficiently and safely. Furthermore, the act of sanding causes less fatigue to the person doing the sanding and the sanding operation is performed in a more consistent and uniform manner.

Other objects and advantages will be readily apparent to those skilled in the art upon reviewing the drawings and the detailed description which follows:

DETAILED DESCRIPTION OF THE INVENTION

Figure 1:
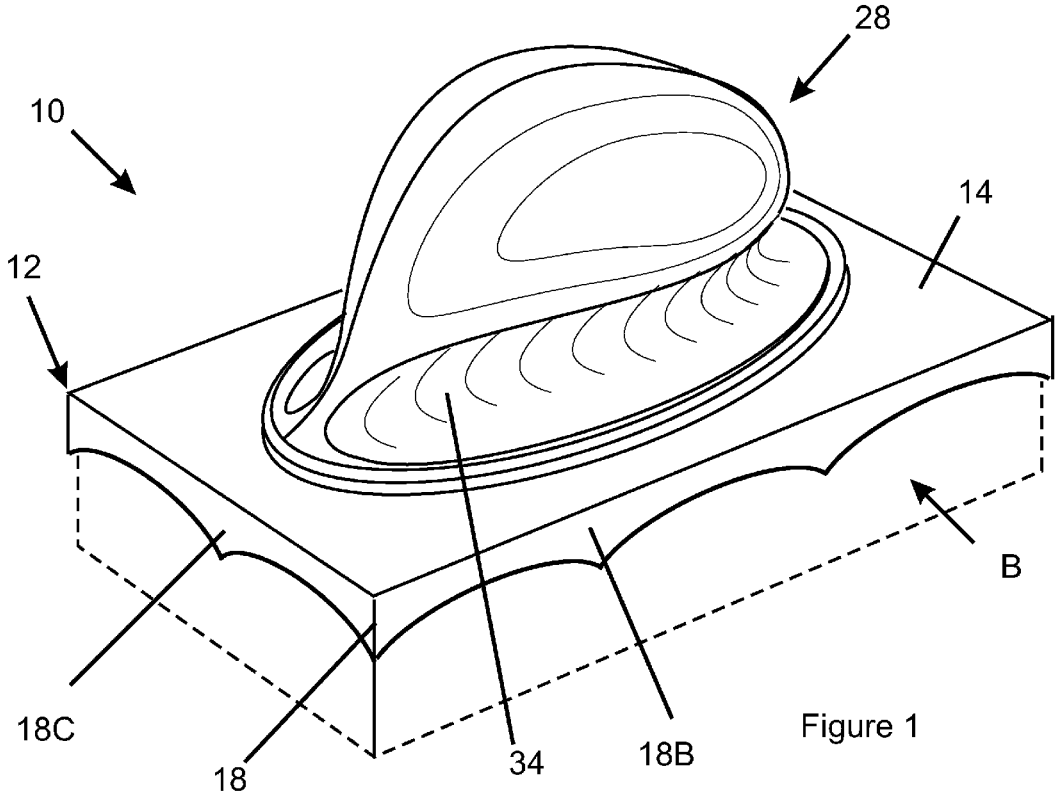
FIG. 1 is a perspective view of a holder for a sanding block of the present invention.
Figure 2:
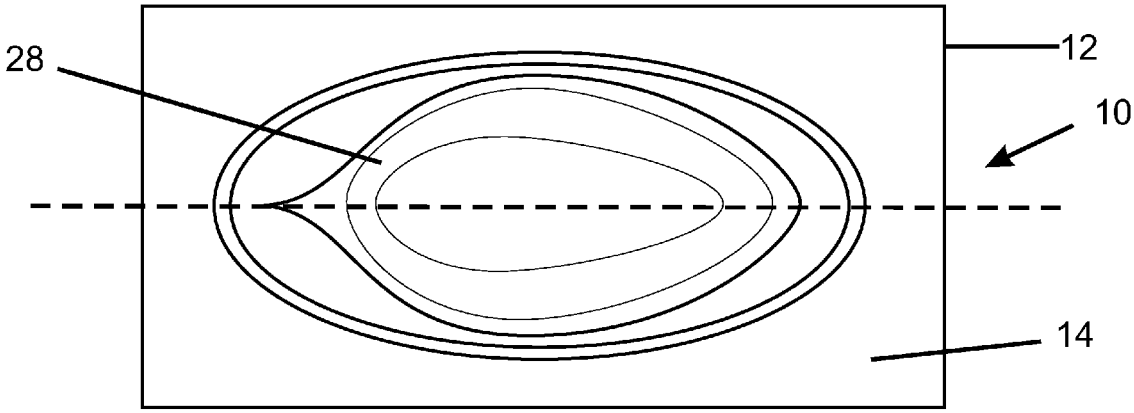
FIG. 2 is top view of the holder for a sanding block of the present invention.
Figure 3:
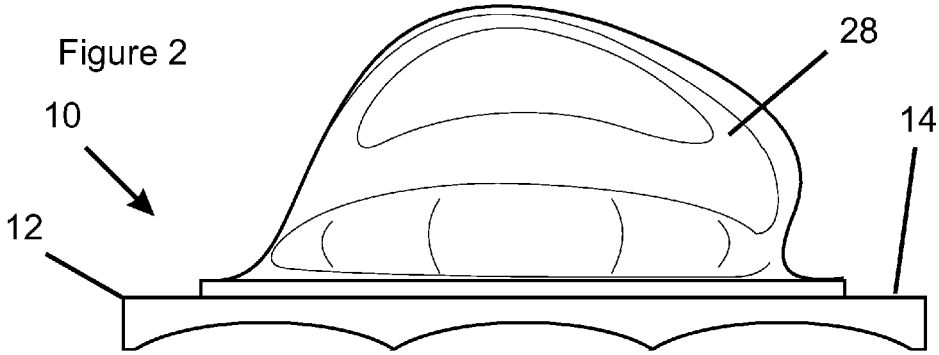
FIG. 3 is side view of the holder for a sanding block of the present invention.
Figures 4, 5:
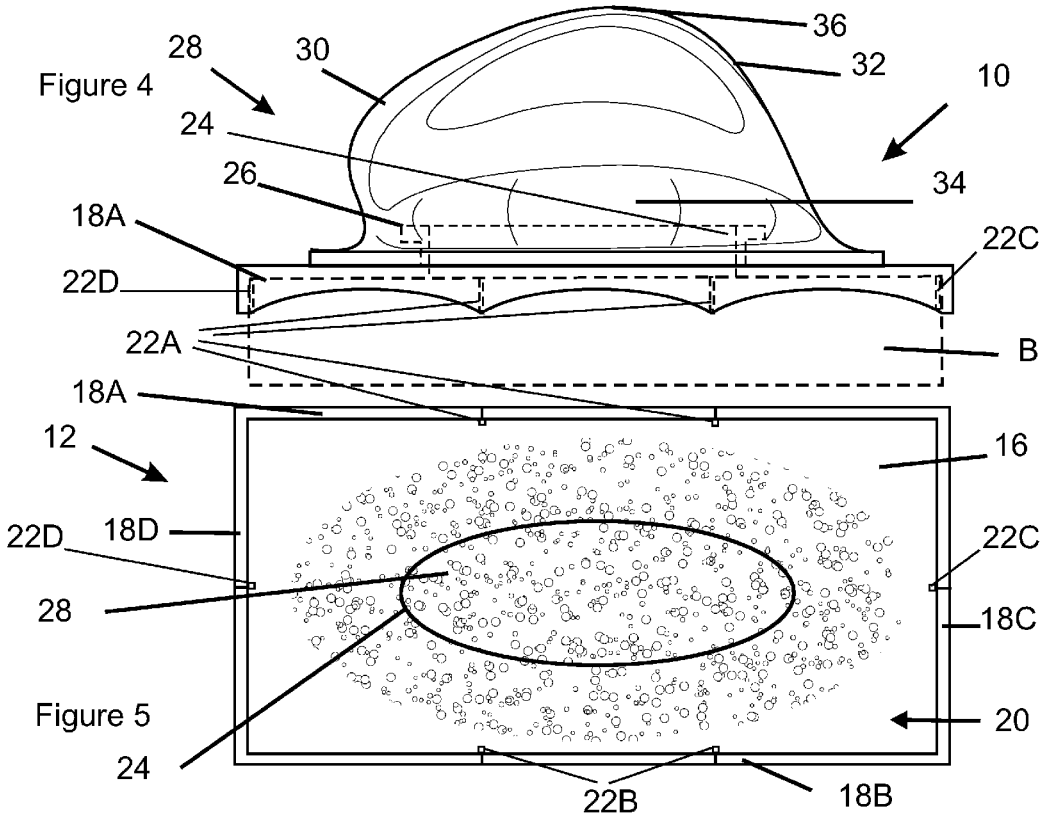
FIG. 4 is another side view of the holder for a sanding block of the present invention.
FIG. 5 is bottom view of the holder for a sanding block of the present invention.
Figure 6:
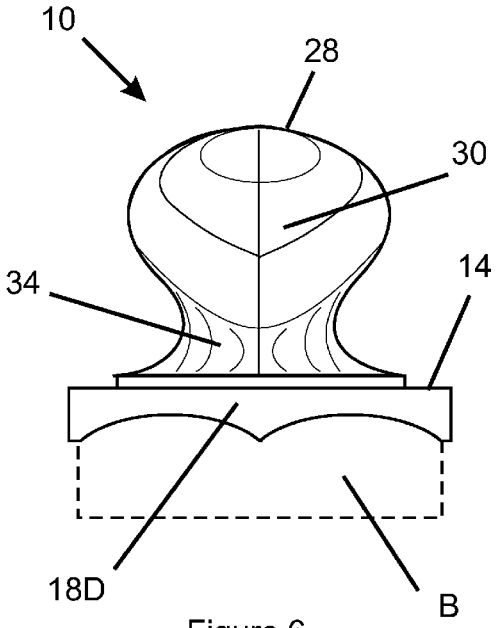
FIG. 6 is a back end view of the holder for a sanding block of the present invention.
Figure 7:
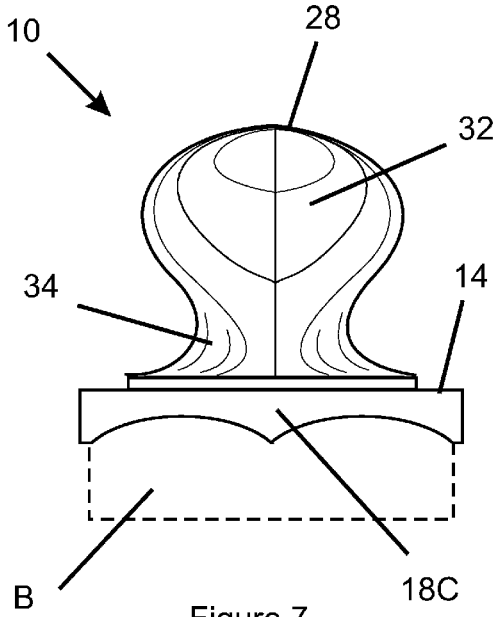
FIG. 7 is front end view of the holder for a sanding block of the present invention.

Referring now to the drawings shown in FIGS. 1-7, the holder for a sanding block B of the invention is generally referred to by the numeral 10. The term "block" used herein is contemplated to include sanding implements such as a sanding sponge or the like.

The holder 10 includes a base 12 having a top surface 14 and a bottom surface 16 and a wall 18 here shown to include four sides 18A, 18B, 18C and 18D extending downward and outward from the bottom surface 16 which together define a sanding block receiving surface 20 to friction fit receive the block B. The sides 18A, 18B, 18C and 18D can include an ornate configuration as seen and include functional inwardly extending ribs 22A, 22B, 22C, and 22D which run from the bottom surface 16 outward to aid in gripping the block B and also enable removability of the base 12 during the mold formation thereof. The receiving surface 20 and the block B have shapes that cooperate with each other to provide friction forces therebetween which are greater that the frictional forces between a working surface of the block B and a surface being sanded in order to accomplish an intended purpose of sanding. The preferred embodiment of the base 10 further includes an opening 24 which can be preferably centrally formed in the top surface 14. In this regard a collar 26 extends upward and outward from the top surface 14 further defining the opening 24 and which purpose will become apparent hereinafter.

The base 12 can preferably be made of a rigid material such as plastic, metal or wood. A preferred material is plastic and can be formed by an injection molding technique from a polymer, such as acrylonitrile butadiene styrene or polyvinyl chloride, to produce a relatively rigid structure. Injection molding can include a manufacturing technique using thermoplastic and thermosetting plastic materials of the type to result in a rigid plastic structure. Molten plastic is injected at high pressure into a mold (not shown) which is the inverse shape of the base 12.

The holder 10 further includes a handle 28 which protrudes, preferably centrally, from top surface 14 of the base 12. The handle 28 is generally of a shape which conforms to the palm of a user's hand and is preferably formed of a polyfoam material, e.g., polyurethane foam, for ease of comfort to the user. The handle 28 can preferably be formed through injection mold wherein the base 12 is previously formed and placed in a mold configured to receive the base 12. The polyfoam material used to make the handle 28 expands through the opening 24 partially covering the bottom surface 16 of the base 12 and about the collar 26 of the base 12 (seen best in FIGS. 4 and 5). This serves to securely mechanically connect the handle 28 to the base 12.

The handle 28 is ergonomically designed, being symmetrically oriented along a longitudinal axis which generally aligns with a central axis of the base 12. The handle 28 has a front end 30 and a disproportionate back end 32. The back end 32 is larger than the front end 30 such that a downward slope exists from the back end 32 to the front end 30 and can preferably be formed in a manner as seen in FIG. 1. The shape of the handle 28 and the orientation of the handle 28, with respect to the base 12 of the present holder 10, are designed such that the sanding block B and the user can interact most efficiently and safely. Furthermore, the act of sanding causes less fatigue to the person doing the sanding and the sanding operation is performed in a more consistent and uniform manner.

The handle 28 includes a recessed surface 34 extending about its perimeter adjacent the base 12. This permits one's hand and fingers to grip the handle 22 in a way such that one's fingers extend within the recessed surface 34 while one's palm rests comfortably on an upper portion 36 of the handle 28 (including the ends 30 and 32).

The above described embodiment is set forth to exemplify the invention and is in no way meant to limit the present invention. It will be readily apparent to those skilled in the art that various modifications, derivations and variations can be made to material and to structure without despairing from scope or essence of the invention. Accordingly, the appended claims should be read in their full scope including any such modifications, derivations and variations.

What is claimed is:

1. A holder for releasably retaining an abrasive block comprising:

a rigid base having a bottom surface and a wall extending outward therefrom which together define a abrasive block receiving surface to friction fit receive the abrasive block, said base defining an open surface, and a polyfoam handle connected to said base by way of said polyfoam material expanding through said open surface and which extends upward from a top surface of said base.

2. The holder of claim 1, wherein said handle is generally of a shape which conforms to the palm of a user's hand for ease of comfort to the user.

3. The holder of claim 1, wherein said handle includes an enlarged upper portion on which one's palm rest and a recessed surface adjacent said base to receive one's fingers.

4. The holder of claim 1, wherein said handle has a front end and a disproportionate back end.

5. The holder of claim 4, wherein said back end is larger than said front end such that a downward slope exists from said back end to said front end.

6. The holder of claim 1, wherein said base is made of a rigid material relative to said handle.

7. The holder of claim 1, wherein said base includes a collar defining said open surface through which said handle extends and is mechanically connected to said base via a molding process by way of said polyfoam material expands through said open surface and partially covering said bottom surface of said base and about said collar of said base.

8. The holder of claim 1, wherein said handle comprises polyurethane foam.

9. The holder of claim 1, wherein said base wall includes an inwardly extending ribbed surface.

10. The holder of claim 1, wherein said handle comprises polyurethane foam.

11. The holder of claim 1, wherein said base wall includes an inwardly extending ribbed surface.

12. The holder of claim 1, wherein said open surface extends substantially across said base.

13. A holder for releasably retaining an abrasive block comprising:

a rigid base made of one of plastic, metal and wood, and having a bottom surface and a wall extending outward therefrom which together define a abrasive block receiving surface to friction fit receive the abrasive block, and a polyfoam handle connected to said base and which extends upward from a top surface of said base, wherein said base includes a collar defining an open surface through which said handle extends and is mechanically connected to said base via a molding process by way of said polyfoam material expanding through said open surface and partially covering said bottom surface of said base and about said collar of said base.

14. The holder of claim 13, wherein said handle is generally of a shape which conforms to the palm of a user's hand for ease of comfort to the user.

15. The holder of claim 13, wherein said handle includes an enlarged upper portion on which one's palm rest and a recessed surface adjacent said base to receive one's fingers.

16. The holder of claim 13, wherein said handle has a front end and a disproportionate back end.

17. The holder of claim 15, wherein said back end is larger than said front end such that a downward slope exists from said back end to said front end.

18. The holder of claim 13, wherein said open surface extends substantially across said base.

* * * * *